US009876318B2

(12) United States Patent
Gao et al.

(10) Patent No.: US 9,876,318 B2
(45) Date of Patent: Jan. 23, 2018

(54) GROUND CONTACTS FOR REDUCED-LENGTH CONNECTOR INSERTS

(71) Applicant: Apple Inc., Cupertino, CA (US)

(72) Inventors: Zheng Gao, San Jose, CA (US); Mahmoud R. Amini, Sunnyvale, CA (US); Nathan N. Ng, Fremont, CA (US); Min Chul Kim, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/268,645

(22) Filed: Sep. 19, 2016

(65) Prior Publication Data

US 2017/0155213 A1 Jun. 1, 2017

Related U.S. Application Data

(63) Continuation of application No. 14/543,717, filed on Nov. 17, 2014, now Pat. No. 9,450,339.
(Continued)

(51) Int. Cl.
*H01R 13/648* (2006.01)
*H01R 13/6582* (2011.01)
(Continued)

(52) U.S. Cl.
CPC ..... *H01R 13/6582* (2013.01); *H01R 13/6591* (2013.01); *H01R 24/60* (2013.01); *H01R 2107/00* (2013.01)

(58) Field of Classification Search
CPC ..... H01R 13/6582
(Continued)

(56) References Cited

U.S. PATENT DOCUMENTS 3,128,138 A 4/1964 Noschese
3,587,029 A 6/1971 Knowles
(Continued)

FOREIGN PATENT DOCUMENTS

CN 101882726 11/2010
CN 101908679 12/2010
(Continued)

OTHER PUBLICATIONS

International Search Report and Written Opinion of the International Seaching Authority dated Mar. 17, 2015 for PCT Patent Application No. PCT/US2015/010253, 12 pages.
(Continued)

*Primary Examiner* — Tulsidas C Patel
*Assistant Examiner* — Peter G Leigh
(74) *Attorney, Agent, or Firm* — Kilpatrick Townsend & Stockton LLP

(57) ABSTRACT

Connector inserts having a high signal integrity and low insertion loss by shielding signal contacts. One example may provide one or more ground contacts between a front opening and signal pins of a connector insert. These ground contacts may have sufficient lever arm to provide a good contact to a corresponding contact in a connector receptacle. To avoid excessive length in the connector insert, embodiments of the present invention may stack a portion of the ground contact above the signal contacts in the connector insert. To reduce excessive capacitance that would otherwise reduce signal impedance, one or more openings may be formed in the ground contacts. To prevent signal contacts from shorting to a shield through this opening, the opening may be covered by tape. The ground contacts may be positioned to avoid encountering power contacts in the receptacle when the insert is inserted into the receptacle.

24 Claims, 9 Drawing Sheets

Related U.S. Application Data

(60) Provisional application No. 62/003,012, filed on May 26, 2014, provisional application No. 61/929,967, filed on Jan. 21, 2014, provisional application No. 61/927,468, filed on Jan. 14, 2014, provisional application No. 61/926,391, filed on Jan. 12, 2014.

(51) Int. Cl.
*H01R 13/6591* (2011.01)
*H01R 24/60* (2011.01)
*H01R 107/00* (2006.01)

(58) Field of Classification Search
USPC ..... 439/607.28
See application file for complete search history.

(56) References Cited

U.S. PATENT DOCUMENTS 4,337,989 A 7/1982 Asick et al.
4,389,080 A 6/1983 Clark et al.
4,516,815 A 5/1985 Venable et al.
4,544,227 A * 10/1985 Hirose ..... H01R 13/6583 439/607.17
4,571,012 A 2/1986 Bassler et al.
4,684,192 A 8/1987 Long et al.
4,808,118 A 2/1989 Wilson et al.
4,875,881 A 10/1989 Caveny et al.
4,950,184 A 8/1990 Caveney et al.
5,037,315 A 8/1991 Collier et al.
5,145,385 A 9/1992 Takano
5,164,880 A 11/1992 Cronin et al.
5,221,212 A 6/1993 Davis et al.
5,318,452 A 6/1994 Fortuna et al.
5,382,179 A 1/1995 Noschese
5,431,578 A 7/1995 Wayne
5,586,911 A 12/1996 Miller
5,591,050 A 1/1997 Sueoka
5,622,522 A 4/1997 Tan et al.
5,674,085 A 10/1997 Davis et al.
5,788,516 A 8/1998 Uggmark
5,913,690 A 6/1999 Dechelette et al.
5,975,935 A 11/1999 Yamaguchi et al.
5,975,957 A * 11/1999 Noda ..... H01R 13/65802 439/607.17
5,997,349 A 12/1999 Yoshioka
6,019,616 A 2/2000 Yagi et al.
6,039,583 A 3/2000 Korsunsky et al.
6,042,424 A 3/2000 LaCoy et al.
6,162,089 A 12/2000 Jacobson et al.
6,203,333 B1 3/2001 Medina et al.
6,287,147 B1 * 9/2001 Lin ..... H01R 23/6873 439/607.27
6,338,652 B1 * 1/2002 Ko ..... H01R 9/0515 439/497
6,447,311 B1 9/2002 Hu et al.
6,565,366 B1 5/2003 Wu
6,685,486 B1 2/2004 Zhang et al.
6,755,689 B2 6/2004 Chu et al.
6,840,806 B2 1/2005 Kodama et al.
6,913,485 B2 7/2005 Ko et al.
6,926,557 B1 8/2005 Yamaguchi et al.
6,981,887 B1 1/2006 Mese et al.
7,052,287 B1 5/2006 Ni et al.
7,074,052 B1 7/2006 Ni et al.
7,086,889 B2 8/2006 Yin et al.
7,086,901 B2 8/2006 Zhang et al.
7,094,103 B2 8/2006 Lai et al.
7,128,588 B2 10/2006 Hu et al.
7,179,124 B2 2/2007 Zhang et al.
7,207,836 B2 4/2007 Tsai et al.
7,238,048 B2 * 7/2007 Olson ..... H01R 13/41 439/607.28
7,269,004 B1 9/2007 Ni et al.
7,314,383 B1 1/2008 Ho et al.
7,364,464 B2 4/2008 Shen et al.
7,407,390 B1 8/2008 Ni et al.
7,445,452 B1 11/2008 Wu
7,462,071 B1 12/2008 Wu
7,466,556 B2 12/2008 Hiew et al.
7,497,737 B2 3/2009 Mikolajczak et al.
7,604,497 B2 10/2009 Wu et al.
7,658,617 B1 2/2010 Brodsky et al.
7,670,156 B2 3/2010 Chen
7,686,656 B2 3/2010 He et al.
7,690,947 B2 * 4/2010 Gu ..... H01R 13/41 439/607.23
7,699,663 B1 4/2010 Little et al.
7,753,724 B2 7/2010 Gong et al.
7,837,506 B1 11/2010 Chiang
7,837,510 B1 11/2010 Hung et al.
7,841,905 B2 11/2010 He et al.
7,878,852 B2 2/2011 Hiew et al.
7,883,369 B1 2/2011 Sun et al.
7,988,491 B2 * 8/2011 Davis ..... H01R 13/6587 439/607.27
7,997,909 B2 8/2011 Xu et al.
8,007,318 B1 * 8/2011 Dunwoody ..... H01R 13/6461 439/607.55
8,011,948 B2 9/2011 Wu
8,011,950 B2 9/2011 McGrath et al.
8,011,968 B2 9/2011 Lai et al.
8,047,875 B2 11/2011 Yamakami et al.
8,052,476 B2 11/2011 He et al.
8,062,053 B2 * 11/2011 Dooley ..... H01R 13/6272 439/354
8,100,720 B2 1/2012 Hsu et al.
8,133,061 B1 3/2012 Ayers, Sr. et al.
8,147,272 B2 4/2012 Rhein
8,251,747 B2 8/2012 He et al.
8,298,009 B2 10/2012 Elkhatib et al.
8,393,907 B2 3/2013 Lee et al.
8,454,381 B2 6/2013 Wu
8,475,218 B2 7/2013 Zheng et al.
8,476,110 B2 7/2013 Lee et al.
8,506,317 B2 8/2013 Bandhu et al.
8,545,273 B1 10/2013 Chen
8,567,050 B2 10/2013 Hiew et al.
8,579,519 B2 11/2013 Wu et al.
8,602,822 B2 12/2013 Siahaan et al.
8,662,933 B2 3/2014 Wu et al.
8,696,388 B2 4/2014 Gao et al.
8,708,718 B2 4/2014 Li et al.
8,708,752 B2 4/2014 Wu
8,747,147 B2 6/2014 Yu et al.
8,764,492 B2 7/2014 Chiang
8,794,981 B1 8/2014 Hayashida et al.
8,808,029 B2 8/2014 Castillo et al.
8,808,030 B2 8/2014 Gao et al.
8,814,443 B2 8/2014 He et al.
8,814,599 B2 8/2014 Wu et al.
8,821,181 B1 9/2014 Lam et al.
8,911,262 B1 12/2014 Leiba et al.
8,992,249 B2 3/2015 Kobayashi et al.
9,065,212 B2 6/2015 Golko et al.
9,065,229 B2 6/2015 Yamaguchi et al.
9,276,340 B2 3/2016 Amini
9,281,608 B2 3/2016 Zhao et al.
9,356,370 B2 5/2016 Lee et al.
9,496,653 B2 * 11/2016 Little ..... H01R 12/724
9,614,310 B2 4/2017 Tsai
9,660,399 B2 5/2017 Hsu
2002/0001982 A1 * 1/2002 Sakurada ..... G06K 19/07735 439/76.1
2002/0142636 A1 10/2002 Murr et al.
2005/0026469 A1 2/2005 Ice et al.
2006/0052005 A1 3/2006 Zhang et al.
2007/0072446 A1 3/2007 Hashimoto et al.
2007/0111600 A1 5/2007 Tokunaga
2007/0115682 A1 5/2007 Roberts et al.
2007/0254517 A1 11/2007 Olson et al.
2009/0023339 A1 1/2009 Kameyama et al.
2009/0042448 A1 2/2009 He et al.
2010/0248544 A1 9/2010 Xu et al.

(56) References Cited

U.S. PATENT DOCUMENTS

| | | | | |
|---|---|---|---|---|
| 2010/0267282 | A1 | 10/2010 | Tsai | |
| 2010/0303421 | A1 | 12/2010 | He et al. | |
| 2011/0151688 | A1 | 6/2011 | Beaman | |
| 2011/0237134 | A1* | 9/2011 | Gao | H01R 13/6271 439/660 |
| 2011/0300749 | A1 | 12/2011 | Sytsma et al. | |
| 2012/0015561 | A1 | 1/2012 | Tsai | |
| 2012/0030943 | A1 | 2/2012 | Hiew et al. | |
| 2012/0282808 | A1 | 11/2012 | Luo | |
| 2013/0005193 | A1 | 1/2013 | Tsai | |
| 2013/0045638 | A1 | 2/2013 | Gui et al. | |
| 2013/0122752 | A1 | 5/2013 | Lu | |
| 2013/0164965 | A1 | 6/2013 | Yin et al. | |
| 2013/0183862 | A1 | 7/2013 | Ni et al. | |
| 2013/0217253 | A1 | 8/2013 | Golko et al. | |
| 2013/0244492 | A1 | 9/2013 | Golko et al. | |
| 2013/0288520 | A1 | 10/2013 | Simmel | |
| 2013/0288537 | A1 | 10/2013 | Simmel | |
| 2013/0330976 | A1 | 12/2013 | Simmel | |
| 2014/0024257 | A1 | 1/2014 | Castillo et al. | |
| 2014/0073183 | A1* | 3/2014 | Golko | H01R 13/6594 439/607.34 |
| 2014/0078695 | A1 | 3/2014 | Shih et al. | |
| 2014/0094066 | A1 | 4/2014 | Do | |
| 2014/0113493 | A1 | 4/2014 | Funamura | |
| 2014/0194005 | A1 | 7/2014 | Little | |
| 2014/0220827 | A1 | 8/2014 | Hsu | |
| 2014/0242848 | A1 | 8/2014 | Golko et al. | |
| 2015/0031240 | A1 | 1/2015 | Yang | |
| 2015/0044886 | A1 | 2/2015 | Little | |
| 2015/0093936 | A1 | 4/2015 | Little | |
| 2015/0131245 | A1 | 5/2015 | Amini et al. | |
| 2015/0162684 | A1 | 6/2015 | Amini et al. | |
| 2015/0171562 | A1 | 6/2015 | Gao et al. | |
| 2015/0200493 | A1 | 7/2015 | Gao et al. | |
| 2015/0207279 | A1 | 7/2015 | Little | |
| 2015/0214673 | A1 | 7/2015 | Gao et al. | |
| 2015/0244111 | A1 | 8/2015 | Ju | |
| 2015/0340782 | A1 | 11/2015 | Amini et al. | |

FOREIGN PATENT DOCUMENTS

| | | | |
|---|---|---|---|
| CN | 102341970 | | 2/2012 |
| EP | 1 085 604 | A2 | 3/2001 |
| EP | 2 228 871 | A2 | 9/2010 |
| EP | 2 590 273 | A2 | 5/2013 |
| GB | 2 067 361 | A | 7/1981 |
| WO | 2011/163256 | A1 | 12/2011 |
| WO | 2012/177905 | A2 | 12/2012 |

OTHER PUBLICATIONS

Invitation to Pay Additional Fees and, Where Applicable, Protest Fee with Partial International Search Report dated Apr. 28, 2015 for PCT Patent Application No. PCT/US2014/065968, 6 pages.

Invitation to Pay Additional Fees and, Where Applicable, Protest Fee with Partial International Search Report dated May 4, 2015 for PCT Patent Application No. PCT/US2014/065996, 7 pages.

International Search Report and Written Opinion of the International Seaching Authority dated Jul. 3, 2015 for PCT Patent Application No. PCT/US2014/065968, 17 pages.

International Search Report and Written Opinion of the International Seaching Authority dated Jul. 10, 2015 for PCT Patent Application No. PCT/US2014/065996, 18 pages.

Notice of Allowance dated Oct. 14, 2015 for U.S. Appl. No. 14/543,768, 9 pages.

Office Action dated Nov. 10, 2015 for U.S. Appl. No. 14/543,717, 16 pages.

Taiwan Office Action dated Nov. 23, 2015 for Taiwan Application No. 103139835, 7 pages.

Office Action dated Nov. 17, 2015 for U.S. Appl. No. 14/543,748, 21 pages.

Office Action dated Dec. 9, 2015 for U.S. Appl. No. 14/543,711, 15 pages.

Office Action dated Jan. 4, 2016 for U.S. Appl. No. 14/543,803, 14 pages.

Notice of Allowance dated Jan. 25, 2016, for U.S. Appl. No. 14/641,353, 8 pages.

Restriction Requirement dated Feb. 16, 2016, for U.S. Appl. No. 14/641,375, 5 pages.

Final Office Action dated Mar. 28, 2016 for U.S. Appl. No. 14/543,711, 9 pages.

Notice of Allowance dated May 25, 2016 for U.S. Appl. No. 14/543,717, 8 pages.

Final Office Action dated Jun. 28, 2016 for U.S. Appl. No. 14/543,748, 21 pages.

Notice of Allowance dated Jun. 27, 2016 for U.S. Appl. No. 14/543,803, 7 pages.

First Action Interview Pilot Program Pre-Interview Communication, U.S. Appl. No. 14/641,375 dated May 16, 2016, 7 pages.

Notice of Preliminary Rejection (English Translation) dated Feb. 16, 2017 in Korean Patent Application No. 10-2016-7012626, 9 pages.

Second Office Action (English Translation) dated Apr. 17, 2017 in Chinese Patent Application No. 201410858208.7, 14 pages.

Notice of Preliminary Rejection (English Translation) dated May 18, 2017 in Korean Patent Application No. 10-2016-7012914, 11 pages.

"Universal Serial Bus Type-C Cable and Connector Specification (Revision 1.2)," USB 3.0 Promoter Group, Mar. 25, 2016, 221 pages.

"Universal Serial Bus Type-C Cable and Connector Specification (Redline Revision from Apr. 3, 2015)," USB 3.0 Promoter Group, Mar. 25, 2016, 248 pages.

"Universal Serial Bus Type-C Cable and Connector Specification (Revision 1.0)," USB 3.0 Promoter Group, Aug. 11, 2014, 171 pages.

Office Action (English Translation) dated May 31, 2017 in Chinese Patent Application No. 201510013108.9, 10 pages.

Notice of Allowance dated Jun. 19, 2017 in U.S. Appl. No. 15/168,036, 8 pages.

Office Action dated Aug. 10, 2017 in U.S. Appl. No. 15/368,691, 11 pages.

Office Action dated Sep. 25, 2017 in U.S. Appl. No. 15/396,640, 17 pages.

* cited by examiner

GROUND CONTACTS FOR REDUCED-LENGTH CONNECTOR INSERTS

CROSS-REFERENCES TO RELATED APPLICATIONS

This application is a continuation of U.S. application Ser. No. 14/543,717, filed Nov. 17, 2014, which claims the benefit of U.S. provisional patent applications No. 61/926,391, filed Jan. 12, 2014, 61/927,468, filed Jan. 14, 2014, 61/929,967, filed Jan. 21, 2014, and 62/003,012, filed May 26, 2014, which are incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices. Power may be transferred with this data, or power may be transferred separately.

Power and data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices to provide pathways for power and data.

These receptacles may be placed along a side of a device and may consume internal space inside the device. Accordingly, it may be desirable to provide receptacles having a reduced depth. Also, the data rates through these connector receptacles may be quite high. To provide these high data rates, it may be desirable that the connector receptacles have a high signal integrity and low insertion loss.

These connector inserts may be inserted into a device receptacle once or more each day for multiple years. It may be desirable that these connector inserts and receptacles are reliable and do not break or wear down prematurely, since such failures may lead to user dissatisfaction with both the cable assembly and the electronic devices that it connects to.

Thus, what is needed are connector inserts and receptacles that have a short depth, a high signal integrity and low insertion loss, and are reliable.

SUMMARY

Accordingly, embodiments of the present invention may provide connector inserts, receptacles, and other structures that have a short depth, a high signal integrity and low insertion loss, and are reliable.

An illustrative embodiment of the present invention may provide a connector insert having a high signal integrity and low insertion loss by including a ground path that includes ground contacts near a front of the connector insert. The ground contacts may be located between a front opening of the connector insert and signal and power contacts in the insert. These front ground contacts may further contact a shield surrounding the signal and power contacts. This arrangement may provide something at least akin to a Faraday cage to shield the signal and power contacts in the insert. These ground contacts may be formed as a separate piece from the shield and from the signal, power, and other ground contacts in the connector insert, though they may be merged with one or more of these other structures. In a specific embodiment, these ground contacts have a sufficient length to provide enough force along a lever arm such that the ground contacts may form a good electrical connection with ground pads on receptacle tongues. This length may also help prevent permanent deformation of the ground contacts.

Placing these ground contacts in front of the signal contacts would, without more, provide an excessively long connector insert. This would increase a depth of a corresponding receptacle. Accordingly, embodiments of the present invention may reduce a length of a connector insert, and thus a depth of a connector receptacle, by placing the ground contacts above the signal, power, and other ground contacts (referred to simply as signal contacts) in the connector insert. This positioning may allow the ground contacts to have sufficient length while also consuming a minimal amount of space and not significantly increasing a length or thickness of the connector inserts.

This arrangement would, without more, increase a capacitance of the signal pins to ground since the spacing between the signal pins and the ground contacts would be minimal. This in turn would reduce signal impedance and degrade signal integrity and increase insertion losses. Accordingly, to reduce the capacitance between the ground contacts and the signal contacts below the ground contacts, embodiments of the present invention may provide ground contacts that may have one or more openings, where the openings are placed above the signal contacts. This reduced capacitance may increase the impedance of the signal contacts thereby improving signal quality and reducing insertion losses. Tape may be placed over the signal pins to prevent inadvertent connections to the ground contacts and to the connector insert shield.

Ground or other appropriate contacts on a tongue in a connector receptacle may be located where they engage the front ground contacts in the connector insert during insertion of the connector insert. To avoid shorting power contacts on the tongue to the front ground contacts, the contacts formed by the leading edge may be spaced such that they do not encounter the power contacts, or make other undesirable connections to other contacts, during insertion. This may help to avoid damage to circuitry connected to either the connector receptacle or the connector insert during insertion.

In various embodiments of the present invention, contacts, shields, ground pieces, and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connector inserts and receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with various standards such as one of the Universal Serial Bus (USB) standards including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector inserts and receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
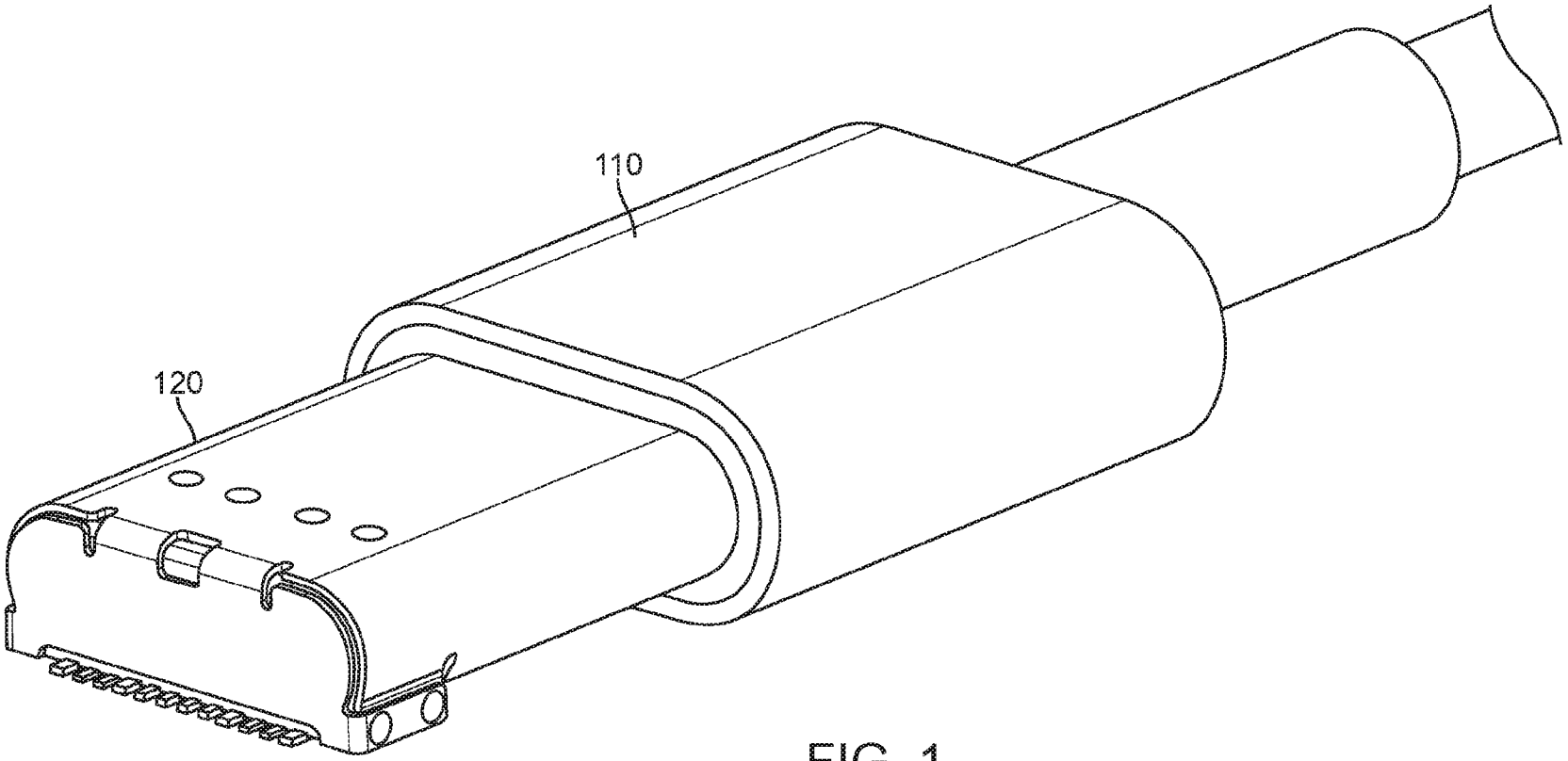
FIG. 1 illustrates a connector insert according to an embodiment of the present invention that has been inserted into a connector receptacle according to an embodiment of the present invention.

FIG. 1 illustrates a connector insert according to embodiments of the present invention that is been inserted into a connector receptacle according to an embodiment of the present invention. This figure, as with the other included figures, is shown for illustrative purposes and does not limit either the possible embodiments of the present invention or the claims.

Specifically, connector insert 110 has been inserted into connector receptacle 120. Receptacle 120 may be located in various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. Connector insert 110 and receptacle 120 may provide pathways for signals that are compliant with various standards such as one of the Universal Serial Bus (USB) standards including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In other embodiments of the present invention, connector insert 110 and receptacle 120 may be used to provide a reduced set of functions for one or more of these standards. In various embodiments of the present invention, these interconnect paths provided by connector insert 110 and receptacle 120 may be used to convey power, ground, signals, test points, and other voltage, current, data, or other information. More information about connector insert 110 and receptacle 120 may be found in co-pending U.S. patent application Ser. No. 14/543,711, filed, Nov. 17, 2014, titled CONNECTOR RECEPTACLE HAVING A SHIELD, which is incorporated by reference.

Embodiments of the present invention may provide a high signal integrity and low insertion loss by shielding signal contacts in connector insert 110. One illustrative embodiment of the present invention may provide this shielding by providing one or more ground contacts between a front opening and signal pins of connector insert 110. These ground contacts may have sufficient lever arm to provide a good contact to a corresponding contact in connector receptacle 120. To avoid excessive length of the connector insert, embodiments of the present invention may stack at least portions of the ground contacts above the signal contacts. To reduce excessive capacitance that would otherwise result in a reduced signal impedance, one or more openings may be formed in the ground contacts. To prevent signal contacts from shorting to a shield through this opening, the opening may be covered by tape. The ground contacts may be positioned to avoid encountering power contacts in the connector receptacle when the connector insert is inserted into the receptacle. An example of such a ground contact is shown in the following figure.

Figure 2:
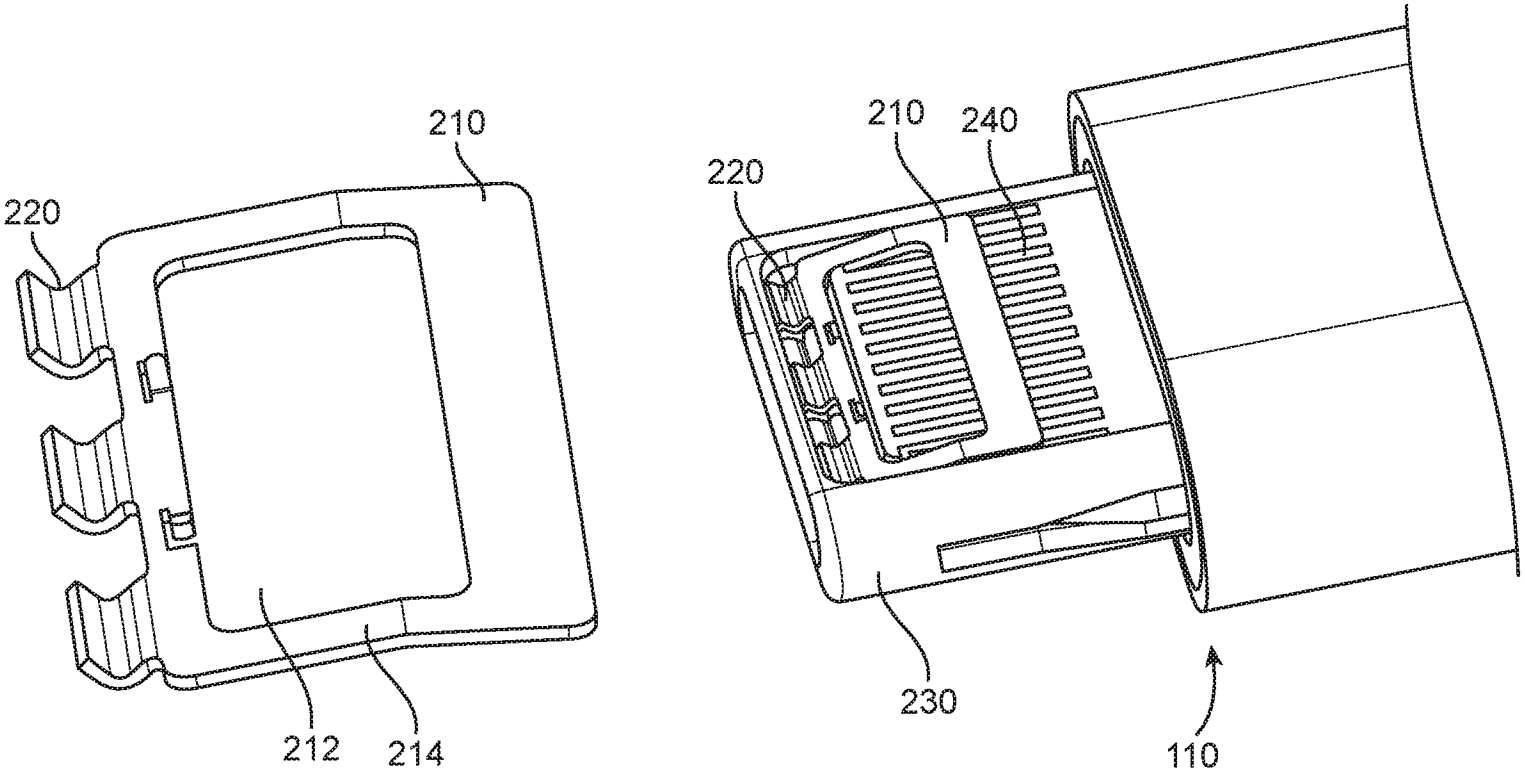
FIG. 2 illustrates a ground contact piece according to an embodiment of the present invention.

FIG. 2 illustrates a ground contact piece according to an embodiment of the present invention. Ground contact piece 210 may include a number of ground contacts 220. Ground contact piece 210 may reside in housing 230 in connector insert 110.

Again, it may be desirable that the inclusion of these ground contacts does not significantly lengthen or increase the thickness of these connector inserts. However, it may be desirable to have a long lever arm such that a strong force may be applied by the ground contacts to corresponding ground contacts on a top of a connector receptacle tongue. In order to keep the added length short while having a long lever arm, ground contact piece 210 may be placed at least partially over signal contacts 240. Placing ground contact piece 210 at least partially over signal contacts 240 allows ground contact piece 210 to provide a long lever arm while only lengthening the connector insert approximately by an amount needed for the actual ground contacts 220. The long lever arm provided by ground contact piece 210 may help to prevent deformation of ground contact piece 210 during the life of the connector insert and may allow a strong contacting force to be applied by ground contacts 220 to the corresponding contacts on a connector receptacle tongue.

Ground contact piece 210 may include opening 212 surrounded by frame 214. Opening 212 may help to reduce the capacitance between signal contacts 240 and ground contact piece 210, thereby improving the impedance at signal contacts 240. A piece of tape (not shown) may be used to electrically isolate signal contacts 240 from a shield around housing 230. Ground contacts 220 may be arranged such that during the insertion of this connector insert into a connector receptacle, ground contacts 220 do not engage power contacts or form other undesirable connections with contacts in the connector receptacle that could cause damage to circuits connected to or associated with the connector insert or connector receptacle.

In various embodiments of the present invention including the various examples shown here, signal pins and ground pieces may be located in either a top or a bottom, or both a top and bottom of a housing in a connector insert.

As before, it may be desirable to provide an electrical connection between ground contacts 220 and a shield on the connector insert or plug. Accordingly, a ground contact piece in the above and other examples may include touch points or fingers. An example is shown in the following figure.

Figure 3:
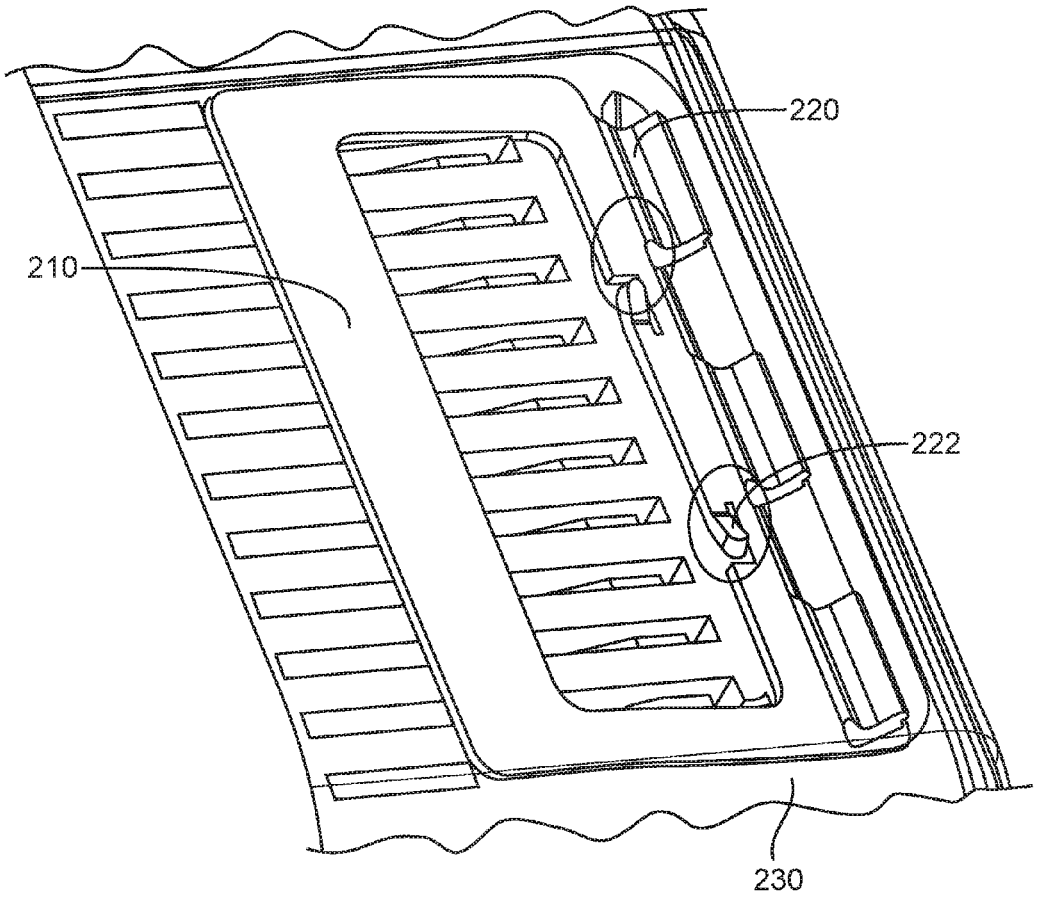
FIG. 3 illustrates a close-up view of a ground piece according to an embodiment of the present invention.

FIG. 3 illustrates a close-up view of a ground piece according to an embodiment of the present invention. Ground contact piece 210 again may include a number of ground contacts 220. Ground contacts 220 may form electrical connections with ground pad, contacts, or other structures in a connector receptacle. For example, ground contacts 220 may form electrical connections with ground pad or contact on a tongue in the connector receptacle. More information about this connection may be found in co-pending U.S. patent application Ser. No. 14/543,711, filed, Nov. 17, 2014, titled CONNECTOR RECEPTACLE HAVING A SHIELD, which is incorporated by reference.

Ground contact piece 210 may further include one or more fingers 222. Fingers 222 may form an electrical connection to a shield, such as a shield around the connector insert housing 230.

In other embodiments of the present invention, it may be desirable to provide additional touch points between a ground piece and a connector insert shield. An example of such a ground piece is shown in the following figures.

Figure 4:
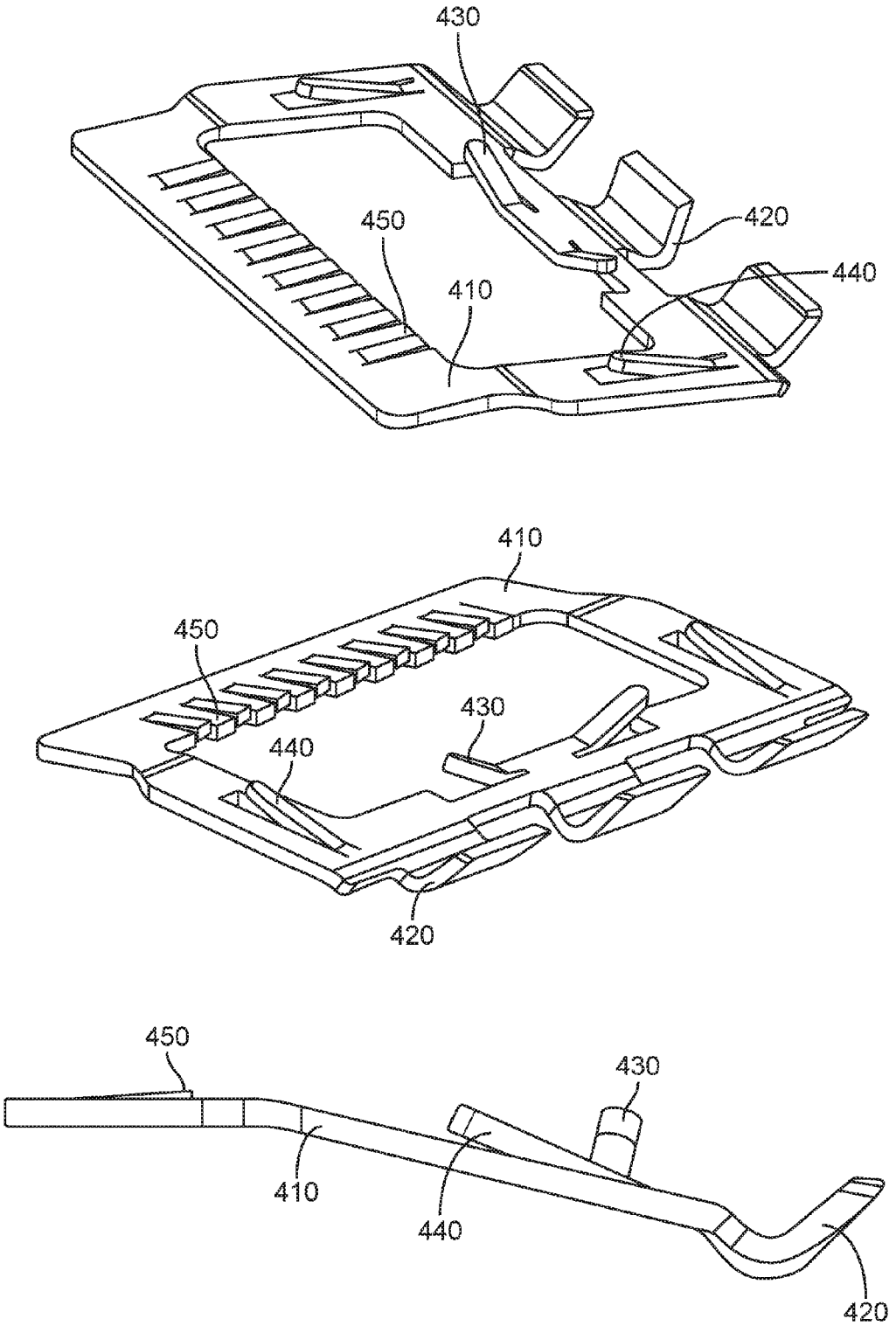
FIG. 4 illustrates a ground piece according to an embodiment of the present invention.

FIG. 4 illustrates a ground piece according to an embodiment of the present invention. Again, ground piece 410 may include ground contacts 420 for forming electrical connections to a ground pad, ground ring, or other structure on a tongue of a connector receptacle. Ground piece 410 may further include front tabs 430 and side tabs 440. During insertion into a connector receptacle, ground contacts 420 may deflect, thereby pushing front ground tabs 430 and side ground tabs 440 into better electrical connection with a connector insert shield. Ground piece 410 may further include contacts 450 for further increasing the connection to a shield. Ground piece 410, as with the other included metal pieces, may be formed by stamping, printing, metal injection molding, or other appropriate procedure.

Figure 5:
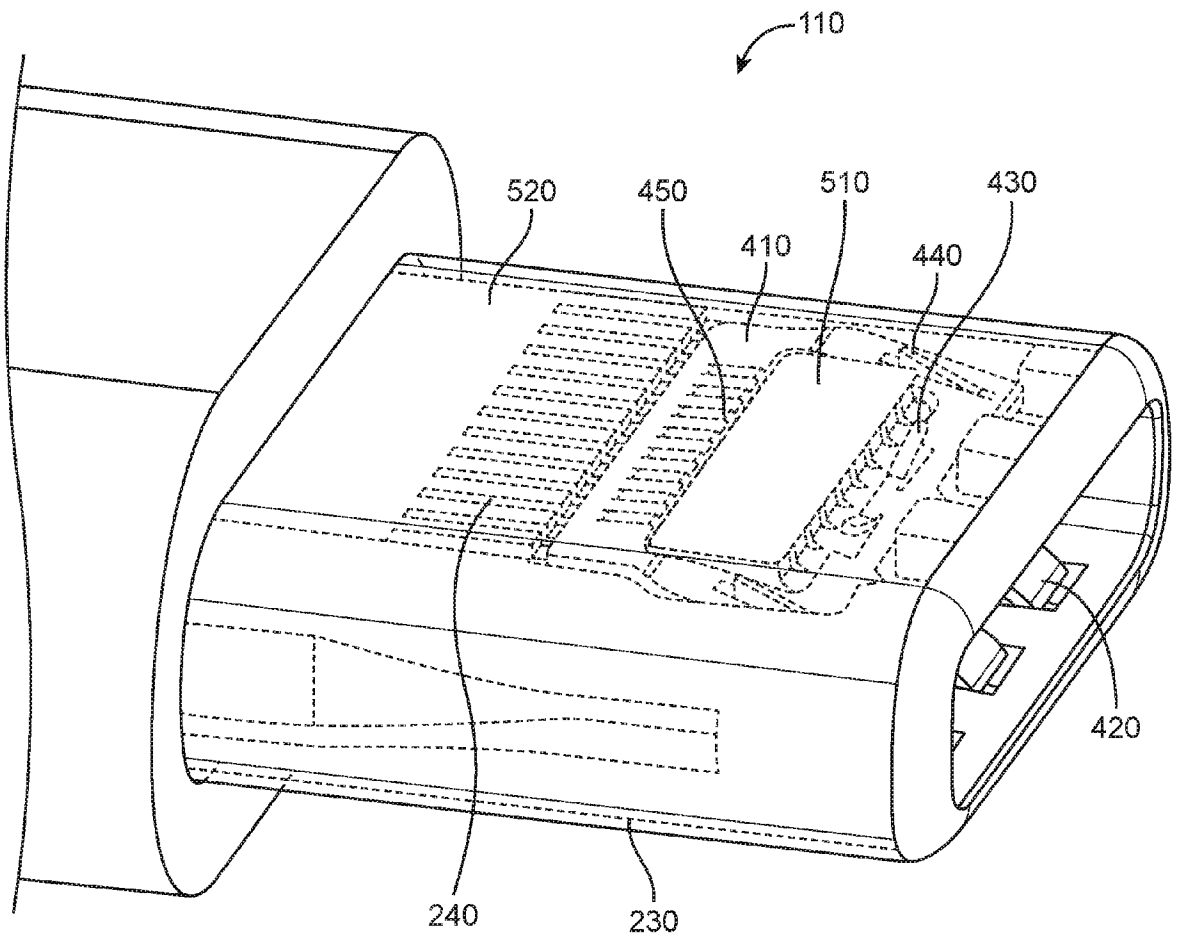
FIG. 5 illustrates a connector insert according to an embodiment of the present invention.

FIG. 5 illustrates a connector insert according to an embodiment of the present invention. Top and bottom ground pieces 410 may reside in a top and bottom of plastic housing portion 230. Top and bottom ground pieces 410 may provide contacts 420 near an opening and in the top and bottom of the connector insert. The connector insert 110 may include signal contacts 240 for power, ground, and signals behind ground contacts 420, further away from an opening of connector insert.

Ground piece 410 may include an opening (not shown) approximately in its center. This opening may closely aligned with an opening in housing 230. These openings may provide room for contacts in a connector insert to deflect when the connector insert is inserted into a connector receptacle. Tape piece 510 may prevent contacts in the connector insert from electrically contacting shield 520 during insertion. Tape piece 510 may be Kapton tape, foam, or other nonconducting material.

Again, it may be desirable to provide a robust electrical connection between ground piece 410 and shield 520. In this way, when ground contacts 220 are electrically connected to a ground on a top of connector receptacle, the ground contacts on a top of a connector receptacle may be well connected to shield 520 via ground piece 410.

Accordingly, ground piece 410 may include front ground tabs 430 and side ground tabs 440. Ground piece 410 may further include rear ground contacts or tabs 450. With this configuration, when this connector insert is inserted into a connector receptacle, ground contacts 220 may deflect, thereby pushing front ground tabs 430 and side ground tabs 440 into an inside surface of shield 520, thereby improving the electrical connection and reducing contact resistance.

Figure 6:
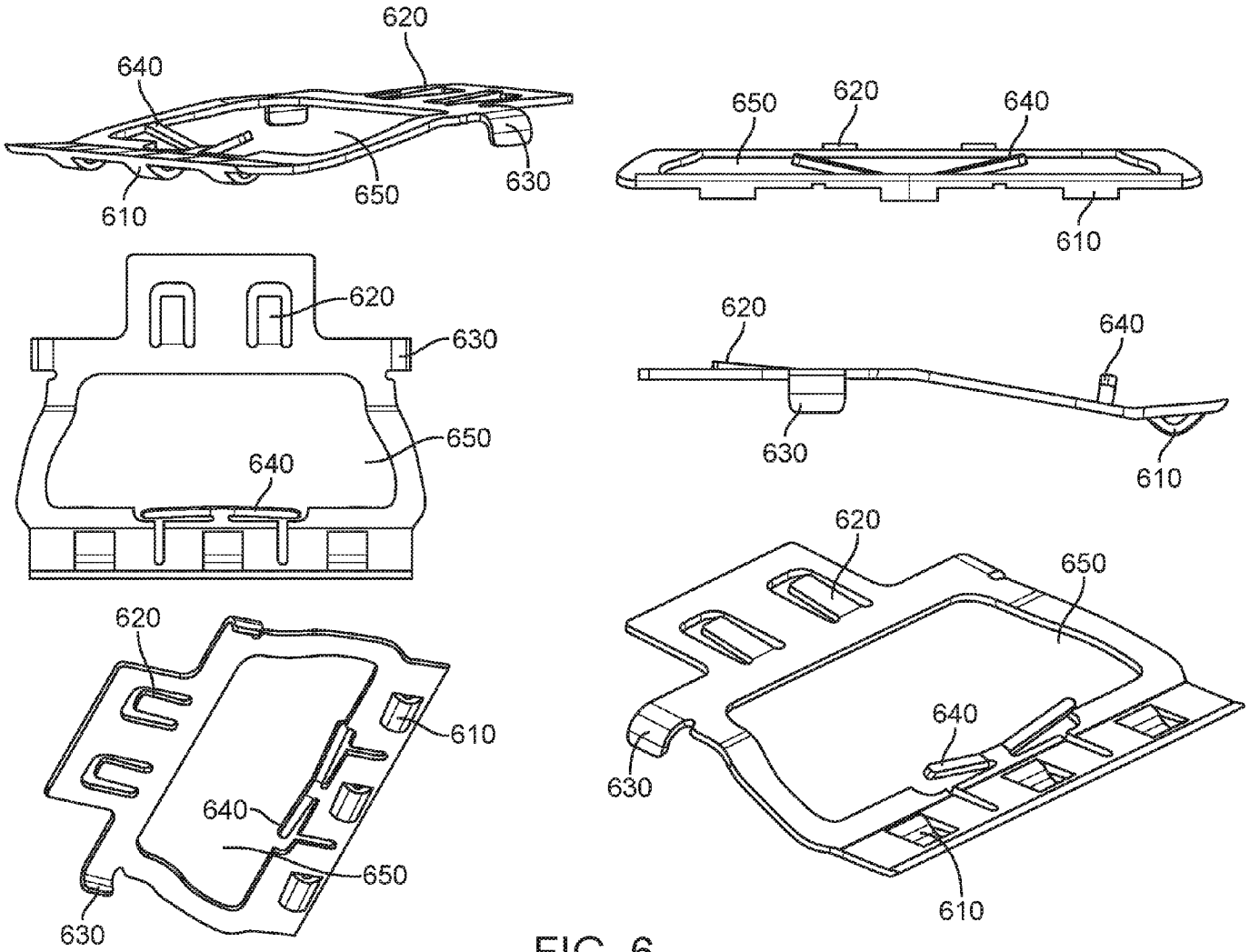
FIG. 6 illustrates another ground piece according to an embodiment of the present invention.

FIG. 6 illustrates another ground contact piece according to an embodiment of the present invention. This ground contact piece may include ground contacts 610. This ground contact piece may further include fingers or touch points 620 and 640 to engage an inside of a connector insert shield. Tabs 630 may be arranged to partially wrap around a plastic housing in the connector insert in order to secure the ground contact piece in place. As before, this ground contact piece may include an opening 650 to reduce capacitance between the ground contact piece and signal contacts in the connector insert. This increased capacitance may increase impedance at the signal contacts, thereby improving signal integrity. As before, when a connector insert using this ground piece is inserted in a receptacle, ground contacts 610 may deflect and push tabs 620 and 640 into a shield of the connector insert, thereby forming an improved ground connection.

Figure 7:
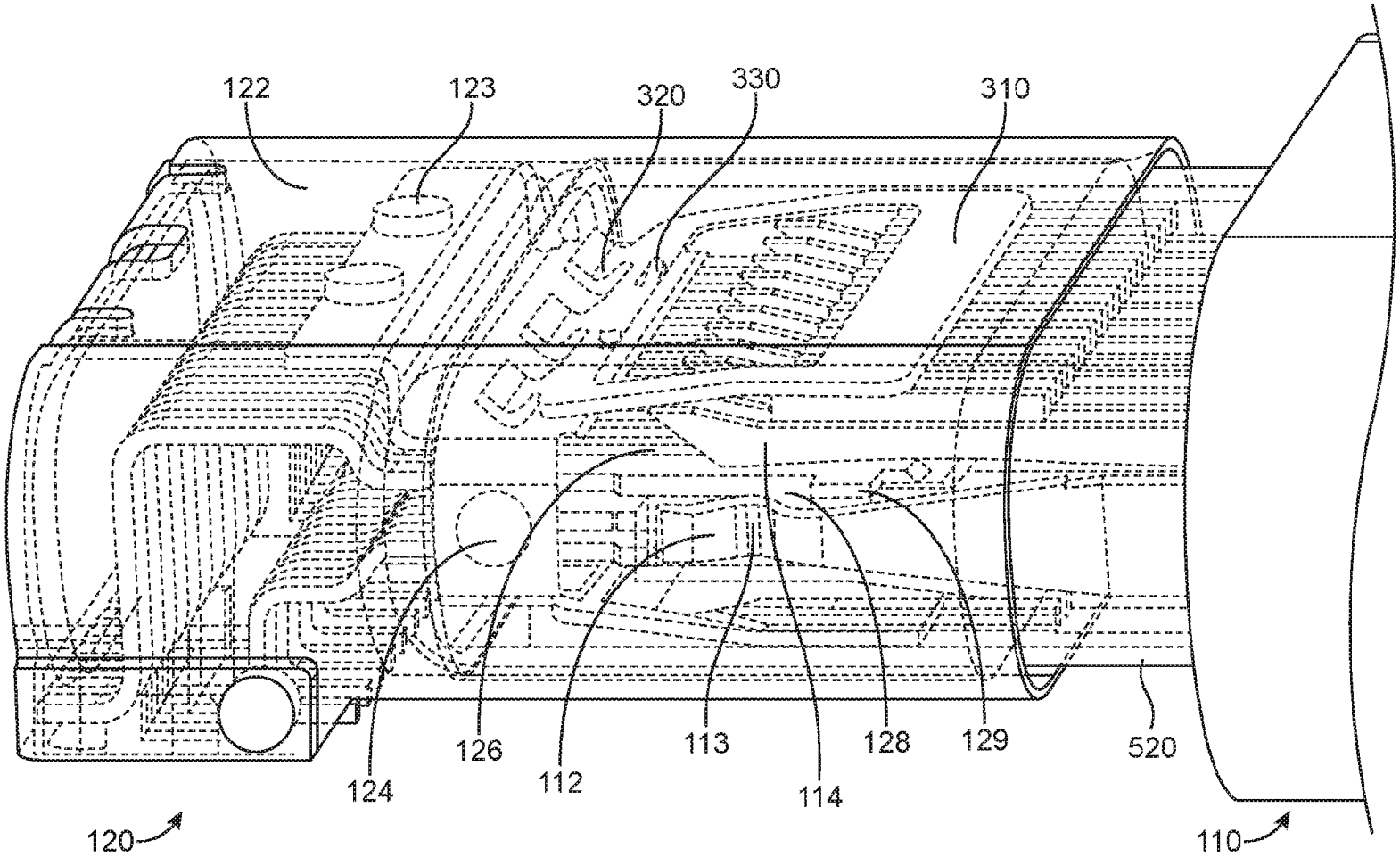
FIG. 7 illustrates another connector insert inserted into a connector receptacle according to an embodiment of the present invention.

FIG. 7 illustrates another connector insert inserted into a connector receptacle according to an embodiment of the present invention. In this example, connector insert 110 may be inserted into connector receptacle 120. Again, more detail on these and other connector inserts and receptacles may be found in co-pending U.S. patent application Ser. No. 14/543,711, filed Nov. 17, 2014, titled CONNECTOR RECEPTACLE HAVING A SHIELD, which is incorporated by reference.

This connector system, as with the other included connector systems may perform at least three functions. The first is to convey signals from a connector insert to a connector receptacle. These signals may include power, ground, and data signals, such as audio and video signals. A second is to shield these signals while they are being transferred. This may prevent or reduce the corruption of the signals during transfer. A third is to provide a retention force such that the connector insert is not inadvertently removed from the connector receptacle. Such accidental extractions may be particularly undesirable during transfer of large files.

Signals may be transferred using pins 114 in the connector insert 110, which may mate with contacts 126 in receptacle 120.

These signals may be shielded in a number of ways. For example, shield 520 of connector insert 110 may electrically connect to ground piece 310 at finger 330. Ground contacts 320 at a front of a connector insert may contact a horizontal portion of ground piece 124 in receptacle 120. Ground piece 124 may electrically connect to connector receptacle shield 122 via connection points 123. Shield 122 of connector receptacle 120 may electrically connect to shield 520 on receptacle 120.

Retention may be provided by side ground contacts 112 engaging notches 125 on tongue 129. Specifically, side ground contacts 112 may include contacting portion 113, which may engage notches 125 on sides of tongue 129. Notches 125 may be plated and connected to ground in the connector receptacle 120, thereby forming another ground path with side ground contacts 112, which may be connected to ground through the connector insert 110.

In various embodiments of the present invention, varying amounts of retention force may be desired. Accordingly, side ground contacts 112 may be pre-biased such that they spring back to fit into notches 125 during insertion. The strength and thickness of side ground contacts 112 may also be adjusted to provide different retention forces for different applications. In some embodiments of the present invention, for example some docking stations, it may be desirable to provide zero retention force, in which case side ground contacts 112 may be omitted.

This connector system, as with the other connector systems shown here, may provide a rotatable connector that may be inserted and either of at least two orientations, which may be 180 degrees apart. This connector system may be free or substantially free of moving parts to improve robustness and reliability. This may also reduce the amount of wear and marring that may occur after usage. Moreover, the shielding provided may allow for transfer of signals and highly isolated manner.

Figure 8:
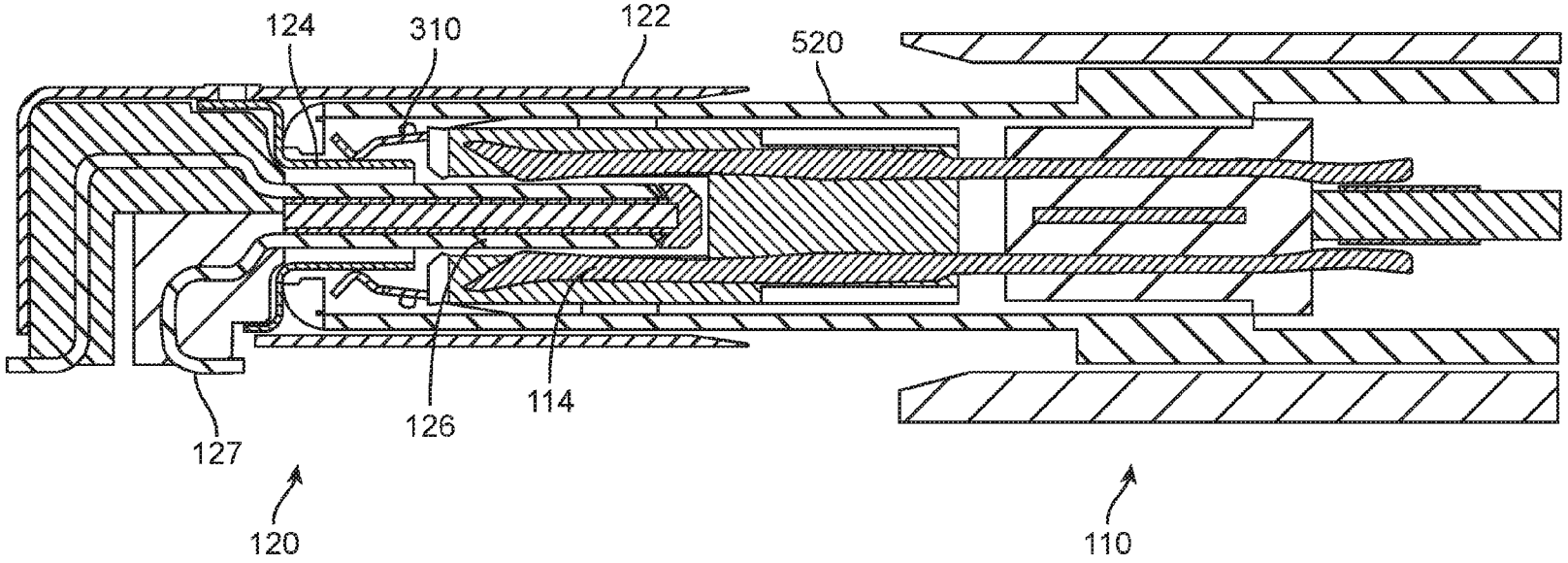
FIG. 8 illustrates a side view of a connector system according to an embodiment of the present invention.

FIG. 8 illustrates a side view of a connector system according to an embodiment of the present invention. Again, contacts 114 in a connector insert 110 may mate with contacts 126 in a connector receptacle 120. Ground piece 310 may form an electrical connection between shield 520 of a connector insert and ground piece 124 of a connector receptacle. Ground piece 124 may further contacts shield 122 on the receptacle, which may in turn contact shield 520 of the connector insert. Contacts 126 in the connector receptacle may emerge from the connector receptacle as contact tails 127. These contact tails may connect to traces or pads on a printed circuit board or other appropriate substrate.

Figure 9:
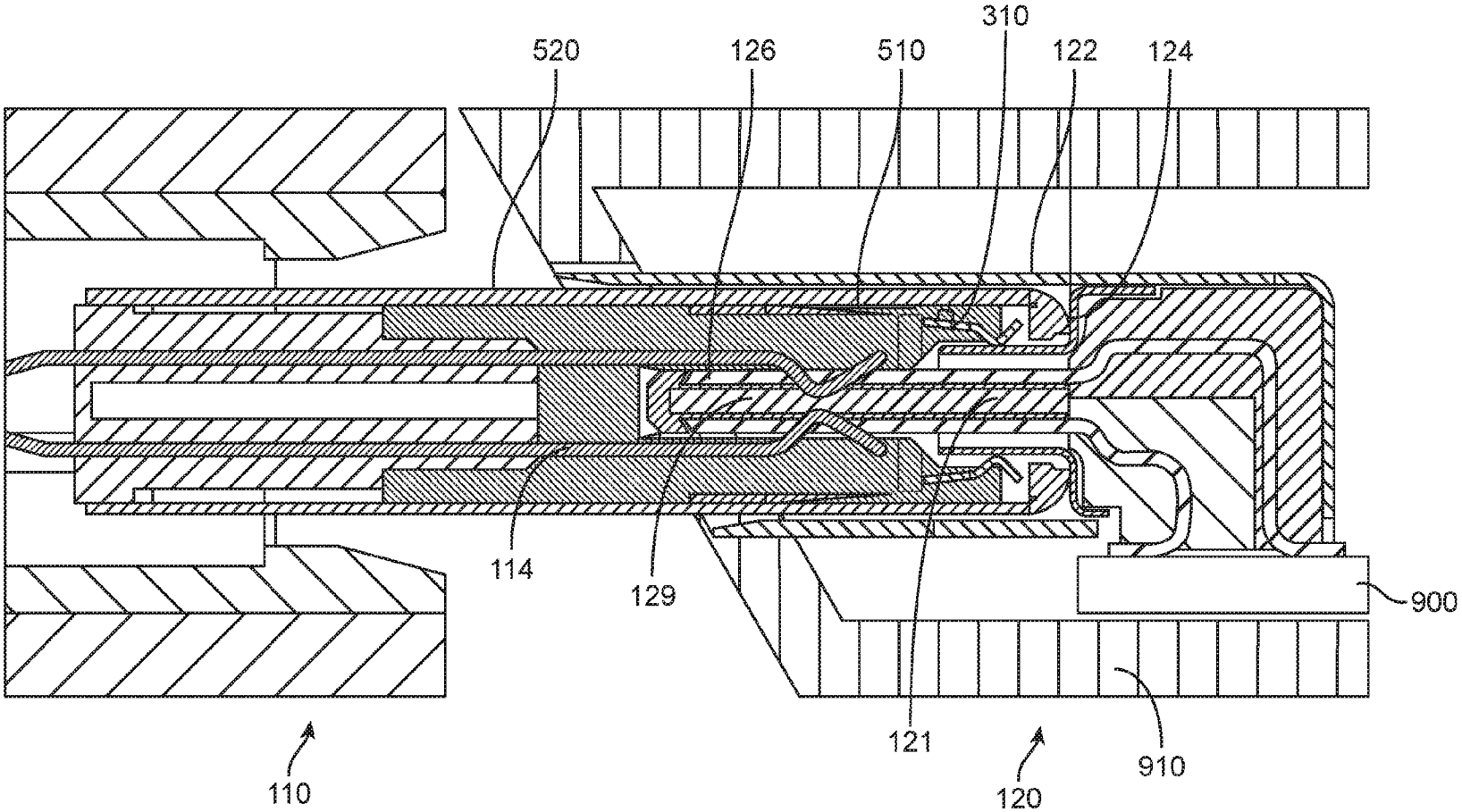
FIG. 9 illustrates a side view of connector system according to an embodiment of the present invention.

FIG. 9 illustrates a side view of connector system according to an embodiment of the present invention. Again, contacts 114 in a connector insert may convey signals by contacting contacts 126 in a connector receptacle. The connector receptacle may be mounted on a printed circuit board or other appropriate substrate 900, which may be located in electronic device housing or enclosure 910. Shield 520 of a connector insert may be attached to or otherwise electrically connected to ground piece 310. Ground piece 310 may make an electrical connection to ground piece 124 in a connector receptacle. Ground piece 124 may electrically connect to shield 122 of the connector receptacle. Shield 122 of the connector receptacle may electrically connect to shield 520 of the connector insert.

In various embodiments of the present invention, a tongue, such as tongue 129, may have a thicker portion, shown here as thicker portion 121. A thicker portion 121 may increase tongue strength and may provide sufficient strength while allowing a front portion of tongue 129 to be relatively thin.

During insertion of the connector insert into the connector receptacle, contacts 114 may deflect when they reach tongue 129. Openings may be provided in the housing and ground contact 310 in the connector insert to allow this deflection. Without more, contacts 114 may electrically contact shield 520 during insertion. Accordingly, isolation tape 510 may be included to electrically isolate contacts 114 from shield 520 during insertion. Isolation tape 510 may be tape such as Kapton tape, or it may be foam or other insulating or nonconductive material.

In various embodiments of the present invention, contacts, ground contacts and pieces, and other conductive portions of connector inserts and receptacles may be formed by stamping, metal-injection molding, machining, micromachining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connector inserts and receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with various standards such as one of the Universal Serial Bus (USB) standards including USB-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector inserts and receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector insert comprising:

a housing supporting a plurality of signal pins, the housing having a front opening to accept a tongue of a connector receptacle when the connector insert is inserted into the connector receptacle, each of the plurality of signal pins extending into the connector insert housing in at least approximately a first direction;

a shield around at least a front portion of the housing; and a ground piece between the housing and the shield, the ground piece comprising:

a rear section, a front section between the rear section and the front opening of the housing, and two side sections joining the front section to the rear section forming a center opening, the front section supporting a ground contact and two ground tabs, the ground tabs contacting the shield, the ground contact between the front opening of the housing of the connector insert and the plurality of signal pins, the ground tabs extending in the first direction.

2. The connector insert of claim 1 wherein the signal pins comprise pins for conveying signals, power, and ground.

3. The connector insert of claim 2 wherein the front section of the ground piece includes three ground contacts.

4. The connector insert of claim 3 wherein the center opening is located over the plurality of signal pins.

5. The connector insert of claim 4 wherein the center opening is at least substantially covered by an insulating layer.

6. The connector insert of claim 1 wherein the ground contact is arranged to engage a receptacle ground contact on a top side of a tongue of the connector receptacle.

7. The connector insert of claim 6 wherein the rear section of the ground piece includes a plurality of rear ground tabs electrically connected to the shield.

8. The connector insert of claim 6 wherein the front section of the ground piece further supports two additional ground tabs, the additional ground tabs extending in a second direction at least approximately orthogonal to the first direction and electrically connected to the shield.

9. The connector insert of claim 6 wherein contacting portions of the plurality of signal pins form electrical connections with corresponding pins in the corresponding connector receptacle when the connector insert and the connector receptacle are mated.

10. A connector insert comprising:

a housing;

a conductive shield around the housing;

a top row of signal pins supported in a top of the housing;

a bottom row of signal pins supported in a bottom of the housing;

a first ground piece between the housing and a top of the conductive shield and having a first ground contact between the top row of signal pins and the leading edge of the connector insert; and a second ground piece between the housing and a bottom of the conductive shield and having a second ground contact between the bottom row of signal pins and the leading edge of the connector insert, wherein the first ground piece and the second ground piece each include a center opening and a front section between the center opening and a leading edge of the connector insert, the front section of the first ground piece supporting the first ground contact, a first ground tab, and a second ground tab, the first ground tab and the second ground tab contacting the conductive shield, the front section of the second ground piece supporting the second ground contact, a third ground tab, and a fourth ground tab, the third ground tab and the fourth ground tab contacting the conductive shield.

11. The connector insert of claim 10 wherein the housing is plastic.

12. The connector insert of claim 10 wherein the conductive shield is metallic.

13. The connector insert of claim 12 wherein the conductive shield is formed of steel.

14. The connector insert of claim 10 wherein the first and second ground contacts are arranged to engage ground contacts on a top and bottom side of a tongue of a connector receptacle.

15. The connector insert of claim 10 wherein the top and bottom rows of signal pins comprise pins for conveying signals, power, and ground.

16. The connector insert of claim 10 further comprising a second housing supporting the conductive shield, the second housing behind the shield.

17. The connector insert of claim 16 the first and second ground contacts are arranged such that undesirable connections to contacts in a connector receptacle are not formed when the connector insert is inserted into the connector receptacle.

18. The connector insert of claim 10 wherein each ground piece includes a center opening.

19. The connector insert of claim 18 wherein the center opening of the first ground piece is located over the top row of signal pins.

20. The connector insert of claim 19 wherein the center opening of the first ground piece is at least substantially covered by an insulating layer.

21. The connector insert of claim 10 wherein the rows of signal pins for the bottom row of signal pins and the top row of signal pins extend in a first direction and the first ground tab and the second ground tab extend in a second direction, the first direction at least approximately orthogonal to the second direction.

22. A connector insert comprising:

a housing;

a conductive shield around a front portion of the housing;

a top row of signal pins supported in a top of the housing;

a bottom row of signal pins supported in a bottom of the housing;

a first ground piece between the housing and a top of the conductive shield and comprising:

a front section supporting a first ground contact between the top row of signal pins and a leading edge of the connector insert, and a first ground tab and a second ground tab, the first ground tab and the second ground tab contacting the conductive shield;

a rear section; and two side sections between the front section and the rear section, the two side sections separate and forming a center opening; and a second ground piece between the housing and a bottom of the conductive shield and comprising:

a front section supporting a second ground contact between the bottom row of signal pins and the leading edge of the connector insert, and a third ground tab and a fourth ground tab, the third ground tab and the fourth ground tab contacting the conductive shield;

a rear section; and two side sections between the front section and the rear section, the two side sections separate and forming a center opening.

23. The connector insert of claim 22 wherein the rows of signal pins for the bottom row of signal pins and the top row of signal pins extend in a first direction, each contact in the top row of signal pins and the bottom row of signal pins extends in a second direction, and the first ground tab and the second ground tab extend in the second direction, the first direction orthogonal to the second direction.

24. The connector insert of claim 23 wherein the first ground contact and the second ground contact are arranged to engage receptacle ground contacts on a tongue of a connector receptacle when the connector insert is mated with the connector receptacle.

* * * * *